US008685312B2

(12) United States Patent
Koyama

(10) Patent No.: US 8,685,312 B2
(45) Date of Patent: Apr. 1, 2014

(54) MELT SPINNING METHOD AND APPARATUS

(75) Inventor: Hiroshi Koyama, Tajimi (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 230 days.

(21) Appl. No.: 13/095,130

(22) Filed: Apr. 27, 2011

(65) Prior Publication Data

US 2011/0285065 A1 Nov. 24, 2011

(30) Foreign Application Priority Data

May 19, 2010 (JP) ..... 2010-115417

(51) Int. Cl.
*D01D 5/084* (2006.01)
*D04H 3/02* (2006.01)

(52) U.S. Cl.
USPC ..... 264/555; 264/103; 264/211.17

(58) Field of Classification Search
USPC ..... 264/103, 210.8, 211.17, 555
See application file for complete search history.

(56) References Cited

U.S. PATENT DOCUMENTS

| | | | | |
|---|---|---|---|---|
| 4,963,298 | A | 10/1990 | Allen et al. | |
| 5,080,569 | A | 1/1992 | Gubernick et al. | |
| 5,098,636 | A | 3/1992 | Balk | |
| 5,124,111 | A * | 6/1992 | Keller et al. | 264/555 |
| 5,160,746 | A | 11/1992 | Dodge, II et al. | |
| 5,695,377 | A | 12/1997 | Triebes et al. | |
| 5,840,633 | A | 11/1998 | Kurihara et al. | |
| 6,001,303 | A | 12/1999 | Haynes et al. | |
| 6,132,661 | A | 10/2000 | Kurihara et al. | |
| 6,247,911 | B1 | 6/2001 | Milligan | |
| 6,248,267 | B1 | 6/2001 | Hosako et al. | |
| 6,495,078 | B1 | 12/2002 | Kurihara et al. | |
| 6,524,521 | B1 | 2/2003 | Kuroiwa et al. | |
| 6,824,729 | B2 | 11/2004 | Oin et al. | |

(Continued)

FOREIGN PATENT DOCUMENTS

| | | |
|---|---|---|
| CN | 1290775 | 4/2001 |
| CN | 1291663 | 4/2001 |

(Continued)

OTHER PUBLICATIONS

China Office action, dated Nov. 20, 2012 along with an english translation thereof.

(Continued)

*Primary Examiner* — Leo B Tentoni
(74) *Attorney, Agent, or Firm* — Greenblum & Bernstein, P.L.C.

(57) ABSTRACT

A melt spinning apparatus includes an apparatus body, a nozzle configured to extrude melted resin in the apparatus body, and a barrel having an air discharge passage arranged around this nozzle to discharge hot air. The discharge passage includes a sloped passage and a parallel passage that extends along the nozzle. At an intersection of imaginary lines extending along the centerlines of the sloped passage, an imaginary merging section is defined. An open end of the nozzle is positioned on the downstream side of the imaginary merging section of the hot air blown diagonally forward toward a periphery of the nozzle. To manufacture a sheet of a nonwoven fabric, the melted resin is discharged from the nozzle and then the hot air swirling diagonally forward is blown toward the periphery of the nozzle. This causes the melted resin to be formed into spiral fibers. Those fibers are blown onto the belt of a conveyor belt apparatus to manufacture a nonwoven fabric sheet.

2 Claims, 3 Drawing Sheets

(56) References Cited

U.S. PATENT DOCUMENTS

| | | | | |
|---|---|---|---|---|
| 6,877,971 | B2 | 4/2005 | Kurihara et al. | |
| 2002/0117782 | A1 * | 8/2002 | Haynes et al. | 264/555 |
| 2002/0197343 | A1 | 12/2002 | Kurihara et al. | |
| 2003/0056335 | A1 | 3/2003 | Kurihara et al. | |

FOREIGN PATENT DOCUMENTS

| | | |
|---|---|---|
| JP | 49-6768 | 2/1974 |
| JP | 4-209862 | 7/1992 |
| JP | 9-279411 | 10/1997 |
| JP | 11-247062 | 9/1999 |
| JP | 2001-98455 | 4/2001 |

OTHER PUBLICATIONS

U.S. Appl. No. 13/095,069 to Hiroshi Koyama et al., filed Apr. 27, 2011.

Japan (JP Appl. No. 2010-115417) Office action, mail date is Jul. 30, 2013.

Japan (JP Appl. No. 2010-115418) Office action, mail date is Jul. 30, 2013.

Japanese Office action, mail date is Nov. 19, 2013.

* cited by examiner

MELT SPINNING METHOD AND APPARATUS

BACKGROUND OF THE INVENTION

The present invention relates to a melt spinning method and an apparatus used in the method for manufacturing a nonwoven fabric by supplying, onto a conveyor belt, fibers formed by extruding melted resin by using a melt blowing method.

The melt blowing method is a melt spinning method for obtaining a nonwoven fabric sheet from fibers (threads) obtained by melting and extruding raw resin. By the melt blowing method, melted raw resin is cast into a mold and extruded by an extruder from a nozzle provided on the mold and, simultaneously, supplied with hot and high velocity airflow from the periphery of the nozzle so that the melted resin may be blown into a shape of fibers (threads). The fibers are supplied onto a conveyor and laminated, to manufacture a nonwoven fabric sheet.

As for this type of spinning method, for example, a laterally arranged web manufacturing method is known which is disclosed in Japanese Laid-Open Patent Publication No. 2001-98455. That is, the method includes a step of extruding melted resin from a spinning nozzle into the shape of fibers; a step of blowing hot primary air from the periphery of the spinning nozzle to vibrate the fibrous melted resin; a step of blowing hot secondary air toward the fibrous melted resin as it vibrates and falls due to the primary air, so that the resin may be spread in a widthwise direction and spun; and a step of laminating the fibrous melted resin onto a conveyor to manufacture laterally arranged webs.

However, the manufacturing method described in the above publication aims at obtaining webs arranged laterally, so that it is necessary to vibrate fibrous melted resin extruded from a spinning nozzle by using primary air and spread it in a widthwise direction by using secondary air. In this case, since the fibrous melted resin extruded from the spinning nozzle is vibrated by blowing the primary air at a high velocity, the fibers may not be elongated stably and, moreover, may be cut easily. In addition, since the secondary air is blown to the fibrous melted resin laterally, the fibers may flow in a turbulent manner and be cut easily, leading to a problem that the fibers cannot easily be formed to be thin and uniform.

SUMMARY OF THE INVENTION

It is an objective of the present invention to provide a melt spinning method and a melt spinning apparatus that can obtain thin and uniform fibers easily and stably without cutting the fibers.

To achieve the foregoing objective, and in accordance with one aspect of the present invention, a melt spinning method for manufacturing a nonwoven fabric with fibers made of resin is provided. The method includes: extruding melted resin from a nozzle having an open end; and blowing hot air toward a periphery of the nozzle in a direction in which the melted resin is extruded during the extruding, thereby forming fibers made of the melted resin. The hot air is blown toward the periphery of said nozzle diagonally forward with respect to the direction in which the melted resin is extruded from the nozzle. An imaginary merging section is defined at a position where this hot air merges imaginarily. The open end of the nozzle is positioned on a downstream side of the imaginary merging section. The hot air is supplied toward the imaginary merging section and formed to be parallel to the flow of the melted resin.

In accordance with another aspect of the present invention, a melt spinning apparatus for manufacturing a nonwoven fabric with fibers made of resin is provided. The apparatus includes an apparatus body, a nozzle having an open end provided in the apparatus body, and a barrel having a discharge passage formed around this nozzle to discharge hot air toward a periphery of the nozzle. The melted resin is extruded from the nozzle. The hot air is blown toward the periphery of said nozzle diagonally forward with respect to the direction in which the melted resin is extruded from the nozzle. An imaginary merging section is defined at a position where this hot air merges imaginarily. The open end of the nozzle is positioned on a downstream side of the imaginary merging section. A flow of the hot air is formed to be parallel to the flow of the melted resin without vibrating the melted resin extruded from the nozzle.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
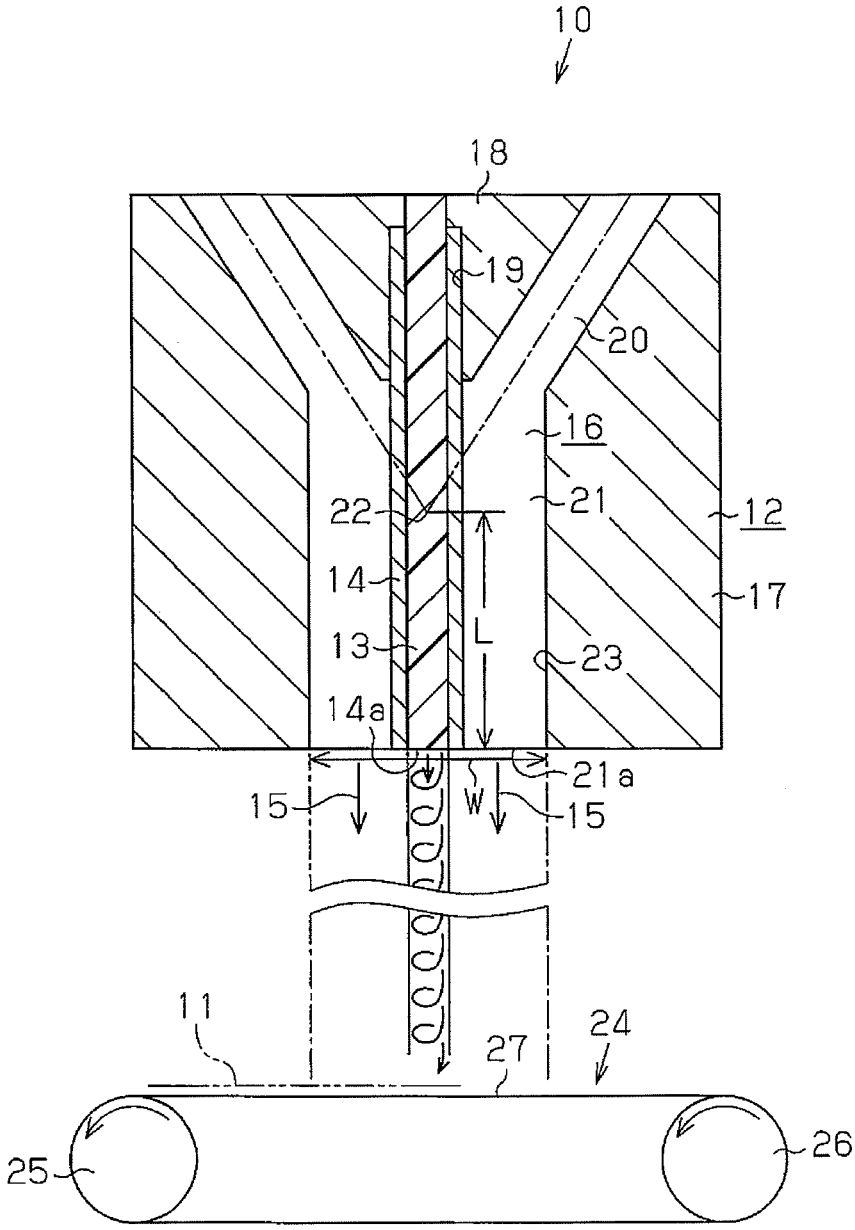
FIG. 1 is a cross-sectional view showing a melt spinning apparatus according to one embodiment of the present invention.
Figure 2:
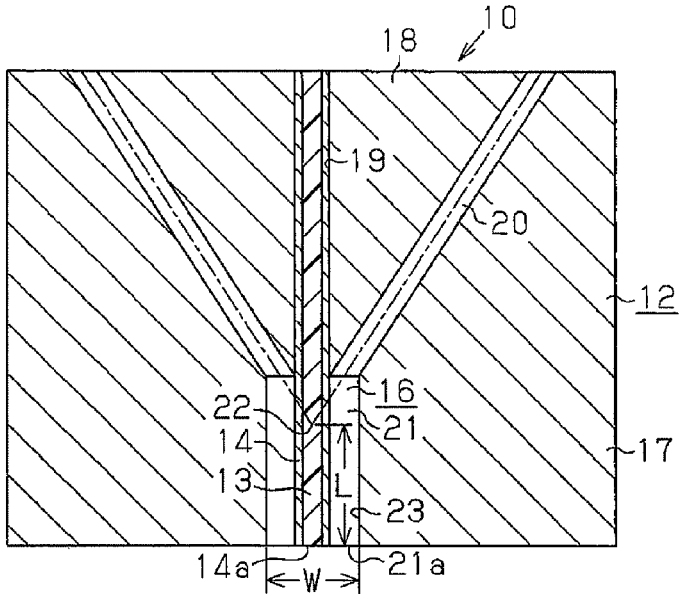
FIG. 2 is a cross-sectional view showing a main portion of a melt spinning apparatus for testing.
Figure 3A:
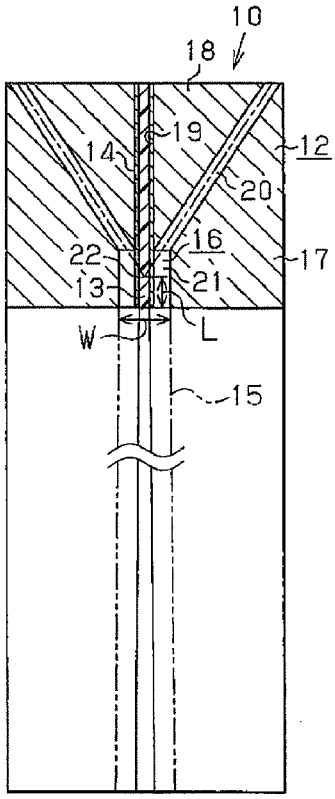
FIGS. 3(*a*) to 3(*c*) are explanatory diagrams showing melted resin blown out of a nozzle and a flow of hot air in cases where the ratio of the length from a merging section of hot air flowing through a sloped passage to a distal end of a parallel passage with respect to the diameter of the parallel passage is 0.6, 1.3, and 0.
Figure 3B:
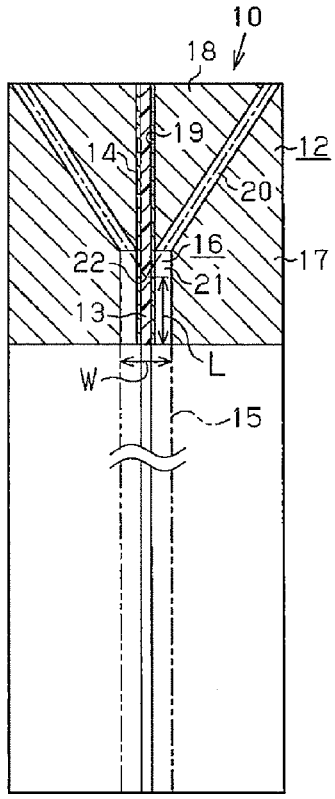
Figure 3C:
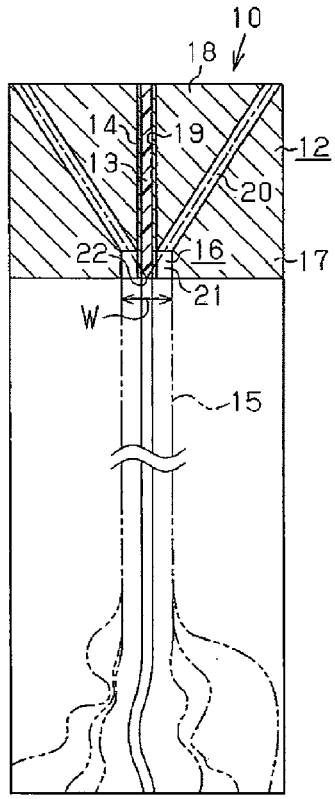

The following will describe in detail one embodiment of the present invention with reference to FIGS. 1 to 3.

As shown in FIG. 1, a melt spinning apparatus 10 for manufacturing a sheet of a nonwoven fabric 11 from raw resin includes an elongated nozzle 14 for extruding melted resin 13 into a shape of fibers (threads) in an apparatus body 12 and a barrel 17. An air discharge passage 16 is formed around the nozzle 14 to discharge hot air 15 toward a periphery of the nozzle 14. The air discharge passage 16 is shaped like a letter Y as viewed in cross-section. The raw resin used may be a thermoplastic resin having a good spinnability such as a polypropylene resin, a polyester resin, or a polyamide resin. The melted resin 13 is formed by melting the raw resin. The melted resin 13 is pushed toward the nozzle 14 and extruded from the nozzle 14 by an extruder, not shown. The nozzle 14 is formed of a metal pipe made of metal such as stainless steel. A nozzle body 18 is formed on the apparatus body 12. By irradiating a plurality of positions along the boundary between the metal pipe and the nozzle body 18 with laser light in a state where the metal pipe is inserted into a fixing hole 19 in the nozzle body 18, the metal pipe is coupled to the nozzle body 18. The nozzle 14 has its inner diameter set to 0.2 to 0.3 mm and its outer diameter set to 0.4 to 0.5 mm, for example.

The above-described discharge passage 16 is formed of a sloped passage 20 positioned on its proximal side and a parallel passage 21 positioned on its distal side. The sloped passage 20 slopes toward the front end so as to approach the nozzle 14. The parallel passage 21 runs parallel to the nozzle 14. The sloped passage 20 and the parallel passage 21 are formed concentrically with the nozzle 14. That is, the parallel passage 21 is formed annularly in such a manner as to surround the nozzle 14. The sloped passage 20 is formed in such a manner as to extend along a surface of a circular cone. At an intersection of imaginary lines extending along the centerlines of the sloped passage 20, an imaginary merging section 22 is defined. The imaginary merging section 22 is a position where the hot air 15 blown to the periphery of the nozzle 14 diagonally forward with respect to a direction in which the melted resin is extruded merges with the nozzle 14 along the sloped passage 20. An open end 14*a* of the nozzle 14 is set on the downstream side of the imaginary merging section 22. By setting the open end 14*a* of the nozzle 14 to such a position, the hot air 15 blown out of the parallel passage 21 can be parallel to a flow of the melted resin 13 extruded from the nozzle 14. If the open end 14*a* of the nozzle 14 is positioned on the upstream side of the imaginary merging section 22, the hot air 15 discharged out of the sloped passage 20 produces turbulence, so that the flow of the hot air 15 cannot be adjusted to be parallel to the flow of the melted resin 13.

The ratio r(r=L/W) of the length L from the imaginary merging section 22 to a distal end 21*a* of the parallel passage 21 with respect to the diameter W of the parallel passage 21 may preferably be 0.6 to 3. In this case, since the flow of hot air 15 is adjusted to be parallel to the flow of the melted resin 13 extruded from the nozzle 14, melt spinning can be performed accurately and uniformly. The ratio r may preferably be larger. However, as the ratio r becomes larger, the melt spinning apparatus 10 also becomes larger in scale. Therefore, an upper limit of the ratio is preferably about 3 with respect to the diameter W. If the ratio r is below 0.6 with respect to the diameter W, the hot air 15 flowing diagonally forward from the sloped passage 20 disturbs the flow of the melted resin 13 extruded from the nozzle 14. As a result, good melt spinning cannot be performed.

Now, a description will be given of results of tests conducted on the above-described ratio r of the length L from the imaginary merging section 22 to the distal end 21*a* of the parallel passage 21 with respect to the diameter W of the parallel passage 21.

FIG. 2 shows a melt spinning apparatus 10 used in the tests, which had the same configuration as that of the melt spinning apparatus 10 shown in FIG. 1. However, the length L from the imaginary merging section 22 to the distal end 21*a* of the parallel passage 21 was changeable. The ratio r in the melt spinning apparatus 10 shown in FIG. 3(*a*) was set to 0.6, the ratio r in the melt spinning apparatus 10 shown in FIG. 3(*b*) was set to 1.3, and the ratio r in the melt spinning apparatus 10 shown in FIG. 3(*c*) was set to 0. The melt spinning tests were conducted on a polypropylene under those conditions, respectively.

As a result, spinning was performed in a favorable manner in that the flow of the melted resin 13 extruded from the nozzle 14 fell almost straightforward together with the flow of the hot air 15 as shown in FIG. 3(*b*). In a case where the ratio r was 0.6, spinning was performed in a substantially favorably manner in that the flow of the melted resin 13 extruded from the nozzle 14 extended substantially parallel to the flow of the hot air 15 as shown in FIG. 3(*a*). In contrast, in a case where the ratio r was 0, that is, the open end 14*a* of the nozzle 14 was positioned to the imaginary merging section 22, desired spinning could not be performed because the flow of the melted resin 13 extruded from the nozzle 14 and that of the hot air 15 bent halfway and fell in a turbulent manner as shown in FIG. 3(*c*).

Although the open end 14*a* of the nozzle 14 is ordinarily positioned in the same plane as the distal end face of the parallel passage 21, the open end 14*a* of the nozzle 14 can be changed arbitrarily between a position 5 mm inward from the distal end 21*a* of the parallel passage 21 and a position 5 mm outward from the distal end 21*a* of the parallel passage 21. Even if the open end 14*a* of the nozzle 14 is changed in such a manner, almost the same advantages as in a case where the open end 14*a* of the nozzle 14 is positioned in the same plane as the distal end surface of the parallel passage 21 can be obtained. However, if the open end 14*a* of the nozzle 14 is positioned more than 5 mm inward from the distal end 21*a* of the parallel passage 21, the hot air 15 flowing along the parallel passage 21 swings due to effects from the hot air 15 from the sloped passage 20. In this case, the melted resin 13 extruded from the nozzle 14 may undesirably stick to an inner wall surface 23 that forms the parallel passage 21. On the other hand, if the open end 14*a* of the nozzle 14 is positioned more than 5 mm outward from the distal end 21*a* of the parallel passage 21, the effects deteriorate of the hot air 15 blown toward the melted resin 13 extruded from the nozzle 14.

The flow rate of the hot air 15 blown out of the parallel passage 21 is set to be larger than the flow rate of the melted resin 13 extruded from the nozzle 14. This causes fibers of the melted resin 13 to be elongated thin in a state where the flow of the hot air 15 is held parallel to that of the melted resin 13. In this case, the flow rate of the hot air 15 is set to such an extent that the melted resin 13 may not vibrate, based on a depressurization action that occurs between the melted resin 13 and the hot air 15 owing to the high velocity of the hot air 15.

A conveyor belt apparatus 24 is disposed below the melt spinning apparatus 10. A belt 27 is stretched over between a pair of front and rear rollers 25 and 26 to go around the rollers 25 and 26. The fibers of the melted resin 13 extruded downward from the nozzle 14 are deposited on the belt 27, to form a sheet of the nonwoven fabric 11.

Next, a description will be given of a melt spinning method for resin by use of the melt spinning apparatus 10 having the configuration described above.

As shown in FIG. 1, the melted resin 13 is discharged downward from the nozzle 14, while the hot air 15 is blown toward the periphery of the nozzle 14 from the sloped passage 20 via the parallel passage 21. The hot air 15 is blown diagonally toward the nozzle 14 from the sloped passage 20 and then blown out of the parallel passage 21 to be parallel to the flow of the melted resin 13. This causes the melted resin 13 to swing and fall. In the course of this swinging and falling, the melted resin 13 is gradually solidified into fibers and spun.

In this case, since the open end 14*a* of the nozzle 14 is positioned on the downstream side of the imaginary merging section 22 of the hot air 15, the hot air 15 discharged from the sloped passage 20 via the parallel passage 21 is adjusted to be parallel to the flow of the melted resin 13. In particular, since the length L from the imaginary merging section 22 of the hot air 15 flowing through the sloped passage 20 to the distal end 21*a* of the parallel passage 21 is set to 0.6 to 3 times the diameter W of the parallel passage 21, the flow of the hot air 15 discharged from the parallel passage 21 is adjusted in a further favorable manner, so as to be parallel to the flow of the melted resin 13. This causes the flow of the melted resin 13 to extend straight downward in the vertical direction in a stable manner such that it is encompassed by the flow of the hot air 15.

In this case, the flow rate of the hot air 15 is set larger than that of the melted resin 13. Therefore, from the periphery of this melted resin 13, a downward tensile force acts on the melted resin 13 falling more slowly than the hot air 15. Accordingly, the fibers of the melted resin 13 are elongated thin downward. The fibers falling together with the flow of the hot air 15 are supplied and laminated on the belt 27 of the conveyor belt apparatus 24. In such a manner, a sheet of the nonwoven fabric 11 is formed. The obtained sheet of the nonwoven fabric 11 moves along with the belt 27, to be acquired at a predetermined position.

A description will be given of advantages of the present embodiment.

(1) By the melt spinning method of the present embodiment, the open end 14*a* of the nozzle 14 is positioned on the downstream side of the imaginary merging section 22 of the hot air 15 blown diagonally forward to the periphery of the nozzle 14. The melted resin 13 is discharged from the nozzle 14 positioned along the centerline of the parallel passage 21. On the other hand, the hot air 15 is blown from the sloped passage 20 via the parallel passage 21 to the outer periphery of the melted resin 13. That is, the hot air 15 is blown through the parallel passage 21 and, therefore, adjusted to be parallel to the flow of the melted resin 13 discharged from the open end 14*a* of the nozzle 14.

Accordingly, the hot air 15 can exhibit the power to elongate the melted resin 13 and also make the fibers of the melted resin 13 hard to cut. Therefore, this melt spinning method enables obtaining thin and uniform fibers easily and stably without cutting the fibers. It is therefore possible to produce nonwoven fabrics having good quality at high yield.

(2) The flow rate of the hot air 15 discharged from the parallel passage 21 is set greater than the flow rate of the melted resin 13 extruded from the nozzle 14. This allows fibers of the melted resin 13 to be elongated effectively in a state where the flow of the hot air 15 is held parallel to that of the melted resin 13. In this case, the diameter of the obtained fibers can be made 3 μm or less.

(3) The melt spinning apparatus 10 has the nozzle 14 configured to discharge the melted resin 13 and the barrel 17. The barrel 17 has the air discharge passage 16 arranged around this nozzle 14 to discharge the hot air 15. The open end 14*a* of the nozzle 14 is positioned on the downstream side of the imaginary merging section 22 of the hot air 15 blown out of the sloped passage 20. Accordingly, the melt spinning apparatus 10 can be made simple in configuration and can obtain thin and uniform fibers easily and stably without cutting the fibers.

(4) The air discharge passage 16 has the sloped passage 20 inclined with respect to the nozzle 14 on its proximal side and the parallel passage 21 extending parallel to the nozzle 14 on its distal side. The above-described ratio r is set to be 0.6 to 3. Accordingly, the flow of hot air 15 is adjusted to be parallel to that of the melted resin 13 discharged from the nozzle 14, enabling performance of melt spinning accurately and smoothly.

(5) The open end 14*a* of the nozzle 14 is arranged to be positioned between the position 5 mm inward from the distal end 21*a* of the parallel passage 21 and the position 5 mm outward from the distal end 21*a* of the parallel passage 21. Accordingly, as long as the open end 14*a* of the nozzle 14 is positioned on the downstream side of the merging section 22, even if the open end is somewhat shifted inward or outward from the distal end 21*a* of the parallel passage 21, the same advantages can be obtained as in a case where it is not shifted. Further, the position of the open end 14*a* of the nozzle 14 need not be designed strictly. This facilitates designing.

(6) The nozzle 14 is formed by coupling a metal pipe to the nozzle body 18. Accordingly, it is possible to machine the nozzle 14 accurately and easily as compared to the case of forming a minute hole in the nozzle body 18.

The present embodiment may be modified as follows.

Figure 4:
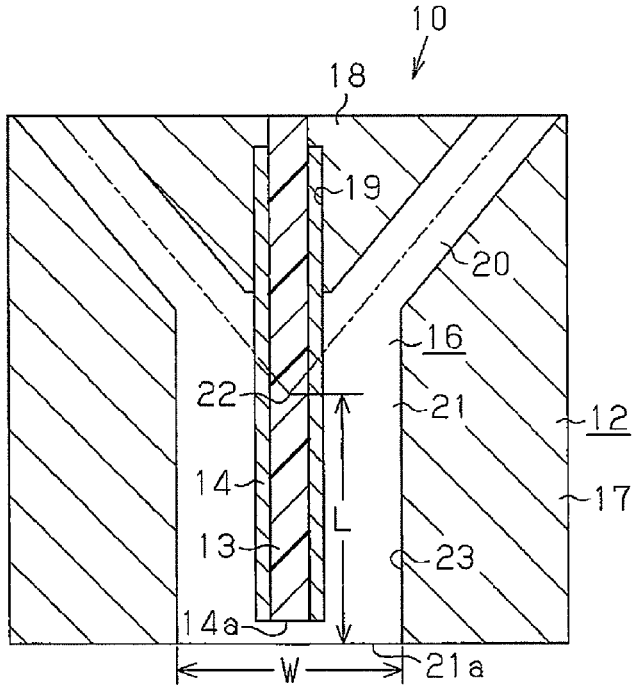
FIG. 4 is a cross-sectional view showing a main portion of a modified embodiment of the melt spinning apparatus.

As shown in FIG. 4, the angle of inclination of the sloped passage 20 with respect to the nozzle 14 may be set larger than that of the sloped passage 20 in the above described embodiment and the imaginary merging section 22 may be set closer to the proximal end than the case of the above described embodiment. Further, the position of the open end 14*a* of the nozzle 14 may be set inward (within 5 mm) from the distal end 21*a* of the parallel passage 21. In this case, it is possible to ensure a sufficient length for the parallel passage 21, thus improving the effects of flow adjusting by the hot air 15.

Figure 5:
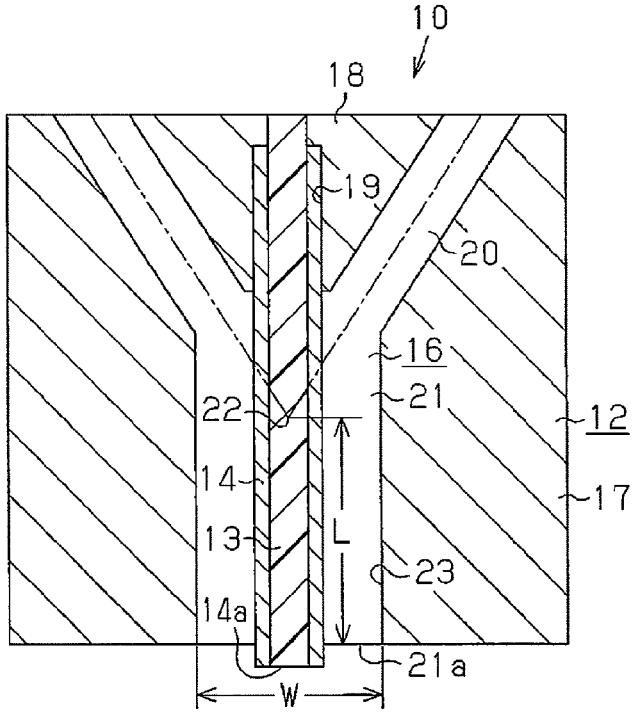
FIG. 5 is a cross-sectional view showing a main portion of a further modified embodiment of the melt spinning apparatus.

As shown in FIG. 5, the diameter W of the parallel passage 21 may be set smaller than the diameter W of the parallel passage 21 in the above described embodiment and the position of the open end 14*a* of the nozzle 14 may be set outward (within 5 mm) from the distal end 21*a* of the parallel passage 21. In this case, it is possible to make the flow rate of the hot air 15 discharged from the parallel passage 21 greater than that in the case of the above described embodiment, thus improving the effects of elongating the fibers of the melted resin 13 extruded from the nozzle 14.

The nozzle 14 may be formed by forming a hole in the nozzle body 18 instead of fixing a metal pipe into the fixing hole 19 in the nozzle body 18.

Therefore, the present examples and embodiments are to be considered as illustrative and not restrictive and the invention is not to be limited to the details given herein, but may be modified within the scope and equivalence of the appended claims.

The invention claimed is:

1. A melt spinning method for manufacturing a nonwoven fabric with fibers made of resin, the method comprising:

extruding melted resin from a nozzle having an open end; and blowing hot air toward a periphery of the nozzle in a direction in which the melted resin is extruded during the extruding, thereby forming fibers made of the melted resin, wherein the hot air is blown toward the periphery of said nozzle diagonally forward with respect to the direction in which the melted resin is extruded from the nozzle, an imaginary merging section being defined at a position where the hot air merges imaginarily with the melted resin being extruded from the nozzle, the open end of the nozzle is positioned on a downstream side of the imaginary merging section, and the hot air is supplied toward the imaginary merging section and flows toward the open end of the nozzle in a direction parallel to a flow of the melted resin.

2. The melt spinning method of claim 1, wherein a flow rate of the hot air is set greater than a flow rate of the melted resin so that the hot air elongates the fibers made of the melted resin.

* * * * *